US010493470B2

(12) United States Patent
Cameron et al.

(10) Patent No.: US 10,493,470 B2
(45) Date of Patent: Dec. 3, 2019

(54) SPRAY NOZZLE FOR HIGH VISCOSITY SPRAY APPLICATIONS WITH UNIFORM SPRAY DISTRIBUTION

(71) Applicant: dlhBowles, Inc., Canton, OH (US)

(72) Inventors: Andrew Cameron, Silver Spring, MD (US); Evan Hartranft, Bowie, MD (US); Shridhar Gopalan, Westminster, MD (US)

( * ) Notice: Subject to any disclaimer, the term of this patent is extended or adjusted under 35 U.S.C. 154(b) by 253 days.

(21) Appl. No.: 15/591,913

(22) Filed: May 10, 2017

(65) Prior Publication Data

US 2017/0341090 A1 Nov. 30, 2017

Related U.S. Application Data

(63) Continuation of application No. PCT/US2015/058947, filed on Nov. 4, 2015.

(Continued)

(51) Int. Cl.

| | |
|---|---|
| ***B05B 1/04*** | (2006.01) |
| *B05B 11/00* | (2006.01) |
| *B65D 83/14* | (2006.01) |

(52) U.S. Cl.

CPC ..... *B05B 1/046* (2013.01); *B05B 1/044* (2013.01); *B05B 11/00* (2013.01); *B65D 83/14* (2013.01)

(58) Field of Classification Search

CPC ..... B05B 1/046; B05B 1/044; B05B 11/00; B65D 83/14

(Continued)

(56) References Cited

U.S. PATENT DOCUMENTS 3,346,195 A * 10/1967 Groth ..... B05B 1/042 239/337

4,022,385 A 5/1977 Krueger (Continued)

FOREIGN PATENT DOCUMENTS

| | | |
|---|---|---|
| DE | 8702010 | 7/1987 |
| EP | 0674946 | 10/1995 |
| GB | 2157592 | 10/1985 |

OTHER PUBLICATIONS

International Search Report in corresponding International Patent Application No. PCT/US15/58947, dated Jan. 13, 2016.

(Continued)

*Primary Examiner* — Alexander M Valvis
*Assistant Examiner* — Qingzhang Zhou
(74) *Attorney, Agent, or Firm* — McDonald Hopkins LLC

(57) ABSTRACT

A nozzle and spray dispenser for generating a uniform substantially flat fan spray pattern when spraying high viscosity fluids (i.e., oils, lotions, cleaning liquids, shear-thinning liquids and gels and similar Newtonian and non-Newtonian fluids having viscosities of 10-100 cP) is configured with an exit orifice 134 defining multiple lip segments 150A, 150B, 150C. Cup-shaped nozzle member 100 has a cylindrical side wall 102 surrounding a central longitudinal axis and has a circular closed end wall with at least one exit aperture passing through the end wall 112. At least one enhanced exit orifice structure is formed in an inner surface of the end wall, and includes two to five lip segments of selected width defining edges at the orifice 134, where each edge segment is defined at the distal edge of a separate and distinct interior wall segment 160A, 160B, 160C which has a selected wall convergence angle β.

19 Claims, 12 Drawing Sheets

Related U.S. Application Data

(60) Provisional application No. 62/077,616, filed on Nov. 10, 2014.

(58) Field of Classification Search
USPC .... 239/583, 589.1, 589, 383, 381, 382, 444, 239/562, 525, 101, 518, 590, 548
See application file for complete search history.

(56) References Cited

U.S. PATENT DOCUMENTS

| | | | | |
|---|---|---|---|---|
| 4,122,845 | A * | 10/1978 | Stouffer | A61C 17/028 239/589.1 |
| 5,639,025 | A | 6/1997 | Bush | |
| 8,297,540 | B1 * | 10/2012 | Vijay | B05B 1/08 239/589 |
| 2003/0062426 | A1 * | 4/2003 | Gregory | B05B 1/185 239/107 |
| 2010/0072307 | A1 * | 3/2010 | Hester | B05B 1/08 239/589.1 |
| 2011/0089250 | A1 | 4/2011 | Zhao et al. | |
| 2011/0233301 | A1 * | 9/2011 | Gopalan | B05B 1/185 239/101 |
| 2012/0234947 | A1 | 9/2012 | Takahashi | |
| 2012/0266376 | A1 * | 10/2012 | Marty | B05B 1/185 4/615 |
| 2017/0183849 | A1 | 6/2017 | Bamford | |

OTHER PUBLICATIONS

European Patent Office, European Search Report for EP App. No. 15 85 8292 dated May 24, 2018.

* cited by examiner

SPRAY NOZZLE FOR HIGH VISCOSITY SPRAY APPLICATIONS WITH UNIFORM SPRAY DISTRIBUTION

REFERENCE TO RELATED APPLICATIONS

This application claims the priority benefit of prior commonly owned (a) copending PCT application number PCT/US15/58947, filed 4 Nov. 2015 and entitled "Spray nozzle for high viscosity (e.g., Oil) applications with uniform spray distribution", and (b) U.S. provisional patent application No. 62/077,616, filed on Nov. 10, 2014, and entitled "Spray nozzle for high viscosity (e.g., Oil) applications with uniform spray distribution".

This application is also related to commonly owned U.S. Pat. No. 7,354,008 entitled "Fluidic Nozzle for Trigger Spray Applications" and PCT application number PCT/US12/34293, entitled "Cup-shaped Fluidic Circuit, Nozzle Assembly and Method" issued on Apr. 8, 2008 to Hester et al (now WIPO Pub WO 2012/145537). The entire disclosures of all of the foregoing applications and patents are incorporated herein by reference.

BACKGROUND OF THE INVENTION

Field of the Invention

The present invention relates, in general, to spray nozzles configured for use when spraying certain consumer goods such as cleaning fluids, cooking or other oils, personal care products and the like. More particularly, this invention relates to a nozzle assembly for use with low-pressure, trigger spray or "product only" (meaning propellant-less) applicators or nozzles for pressurized aerosols (especially Bag-On-Valve and Compressed Gas packaged products).

Discussion of the Prior Art

Generally, a trigger dispenser for spraying consumer goods is a relatively low-cost pump device for delivering liquids from a container. The dispenser is held in the hand of an operator and has a trigger that is operable by squeezing or pulling the fingers of the hand to pump liquid from the container and through a spray head incorporating a nozzle at the front of the dispenser.

Such manually-operated dispensers may have a variety of features that have become common and well known in the industry. For example, a prior art dispenser may incorporate a dedicated spray head having a nozzle that produces a defined spray pattern for the liquid as it is dispensed or issued from the nozzle. It is also known to provide nozzles having adjustable spray patterns so that with a single dispenser the user may select a spray pattern that is in the form of either a stream or a substantially circular or conical spray of liquid droplets.

Many substances are currently sold and marketed as consumer goods in containers with such trigger-operated spray heads, as shown in FIG. 1A. Examples of such substances include air fresheners, window cleaning solutions, carpet cleaners, spot removers, personal care products, weed and pest control products, and many other materials useful in a wide variety of spraying applications. Consumer goods using these sprayers are typically packaged with a bottle that carries a dispenser which typically includes a manually actuated pump that delivers a fluid to a spray head nozzle which a user aims at a desired surface or in a desired direction. Although the operating pressures produced by such manual pumps are generally in the range of 30-40 pounds per square inch (PSI), the conical sprays are typically very sloppy, and spray an irregular pattern of small and large drops. For fluids of thicker viscosity, these prior art spray heads typically include spray nozzles that may only generate a fluid jet, or not work at all.

Sprayer heads recently have been introduced into the marketplace which have battery operated pumps in which one has to only press the trigger once to initiate a pumping action that continues until pressure is released on the trigger. These typically operate at lower pressures in the range of 5-15 PSI. They also suffer from the same deficiencies as noted for manual pumps; plus, they generally have even less variety in or control of the spray patterns that can be generated due to their lower operating pressures.

Aerosol applications are also common and now use Bag-On-Valve ("BOV") and compressed gas methods to develop higher operating pressures, in the range of, e.g., 50-140 PSI rather than the previously-used costly and less environmentally friendly propellants. These packaging methods are desired because they can produce higher operating pressures compared to the other delivery methods, as mentioned above.

Some commercial products are packaged with dispensers configured to generate a product spray in a selected spray pattern. The nozzles for typical commercial dispensers (see, e.g., FIGS. 1B and 1C) are typically of the molded "cap" variety, having channels producing selected spray or stream patterns when the appropriate channel is lined up with a feed channel coming out of a sprayer assembly. Some of these prior art nozzles (e.g., 30) are traditionally referred to as flat fan spray shear nozzles inasmuch as the spray they generate is generally sheared within the nozzle assembly to form a flat fan spray (as opposed to a stream) having droplets of varying sizes and velocities scattered across a wide angle. Traditional flat fan spray nozzles (e.g., 30, as shown in FIGS. 1C-1F consist of a converging fluid channel or feed which is distally terminated in a slot-shaped exit orifice 34 defined by spaced, parallel, first and second opposing fluid flow shearing lips $L_1$, $L_2$ or edges.

For many consumer product fluids, traditional flat fan spray nozzle 30 generates an acceptable and substantially planar flat fan spray with the plane of the spray fan being parallel with and between the exit orifice's spaced, parallel, first and second opposing fluid flow shearing lips $L_1$, $L_2$, where the fan width is partly a function of the nozzles feed width FW and the thickness of the spray fan is partly a function of the fluid feed channel's convergence angle β (Beta, best seen in FIGS. 1D and 1E). These traditional flat fan spray shear nozzles are not suitable for spraying any fluid, however. For those who need to spray high viscosity liquids at lower pressures, the prior art nozzle 30 has proven to be unacceptable. Specifically, for high viscosity fluids at low pressures (e.g., without the use of propellants), the performance of traditional flat fan spray nozzles has been unacceptable. There is also a need to obtain a uniform coating or spray distribution with high viscosity liquids.

There is a need for a nozzle which can provide an acceptable uniform flat fan spray with liquids in the range of 10-100 centiPoise (cP) to be sprayed in trigger spray applications where pressures up to 60 pounds per square inch (PSI) are available. It can easily be also used with aerosols, specifically bag-on-valve (BOV) or compressed gas, where pressures up to 140 PSI are available. The prior art nozzles (e.g., 30) are able to spray high viscosity liquids in the above mentioned range. However, the spray distribution obtained with prior art nozzles is highly non-uniform with excessive volume at fan edges. When applicants sprayed viscous liquids (i.e., liquids such as oils or lotions with viscosities of 10-100 cP) with traditional nozzle 30, the spray impacting the center of the fan pattern comprised only about 10% of the fluid, whereas the fluid impacting the opposing ends of the fan pattern comprised about 90% of the fluid. There is a need to spray viscous liquids and apply a uniform coating/distribution, to enable a user to obtain a uniform coating (spray distribution) of liquid without excessive volume at the edges of the spray fan.

Examples of product spray applications which would benefit from such a nozzle include oils, sunscreen lotions, lotions, cleaning liquids, shear-thinning liquids and gels, etc.

There is a need, therefore, for a cost effective substitute for the traditional nozzles of the prior art which will permit a user to spray viscous liquids and obtain a uniform coating on a surface, which is impossible unless the fluid spray distribution along the spray fan's transverse axis is substantially uniform. There is also a need for a nozzle configuration which enables a user to generate and aim a uniform coating (spray distribution) of liquid without excessive volume at the edges of the spray fan.

SUMMARY OF THE INVENTION

The applicants have studied the prior art flat fan spray shear nozzles (e.g., as illustrated in FIGS. 1C-1F) and identified the reasons that those nozzles, when spraying high viscosity liquids, provide such an uneven distribution of spray along the spray fan's width. As noted above, those traditional flat fan spray shear nozzles consist of a converging liquid channel or feed lumen which is distally terminated in a slot-shaped exit orifice having features (e.g., spaced, parallel, first and second opposing fluid flow shearing lips $L_1$, $L_2$) which use the distally flowing liquid's kinetic energy to shear the liquid into droplets and project those droplets from the outlet orifice into a distally projecting spray pattern, but when high viscosity liquids or fluids (i.e., liquids such as oils or lotions with viscosities of 10-100 cP) are used, the fluid spray is very heavy-ended, with almost no spray seen in the center of the "spray fan". The present invention solves this problem by providing a new nozzle shearing lip configuration.

The applicants have undertaken significant research and development work with the goal of providing a nozzle to spray the subject high viscosity liquids at lower pressures, and specifically low pressures without the use of propellants. This development work also sought to develop a nozzle for spraying a uniform coating or spray distribution with the subject high viscosity liquids. The nozzle configuration and method of the present invention targets spray applications for liquids in the range of 10-100 cP to be sprayed in trigger spray applications (e.g., using pumping mechanisms such as those shown in FIG. 1A) where pressures up to 60 PSI are available. It can easily be also used with aerosols (e.g., using mechanisms such as those shown in FIG. 1B), and specifically bag-on-valve (BOV) or compressed gas, where pressures up to 140 PSI are available. The nozzle assembly and method of the present invention has been demonstrated to reliably generate sprays of the subject viscous liquids (e.g., oils, sunscreen lotions, other lotions, cleaning liquids, shear-thinning liquids and gels, etc.) and provide a uniform coating/distribution without excessive volume at the edges of the spray fan.

The nozzle construction of the present invention differs from the prior art flat fan spray shear nozzle of FIGS. 1C-1F by incorporating several new features. The most noticeable is the crenellated appearance of plural distinct, discontinuous shear inducing edge segments or lips defining the exit orifice with multiple lip surfaces instead of a single continuous lip edge (e.g., $L_1$ or $L_2$). Applicants' new multi-lip configuration enables significantly enhanced control of spray volume distribution, and is especially well suited for controlling the distribution of liquid volume across the spray fan for high viscosity liquids. In an exemplary embodiment, fluid flow enters through a rectangular feed having a lumen height Fh and a lumen width Fw. Flow in the feed lumen is directed distally or downstream to an exit orifice by planar, parallel side walls and converging top and bottom walls. In the prior art nozzles (e.g., 30) the exit orifice (e.g., 34) is characterized by an aperture defined between opposing single continuous lips (e.g., $L_1$, $L_2$) each defined at the distal end of a top or bottom wall segment having one angle or convergence β (Beta, best seen in FIGS. 1D and 1E). While this invention is described in these exemplary embodiments as used with a rectangular feed lumen, the multi lip exit orifice of the present invention can also be used with a circular or elliptical cross section feed lumen.

In the present invention, the exit orifice is bounded by multiple separate discontinuous lips or edges. These separate or discontinuous lips are each formed at the distal end of separate and distinct interior wall segments having selected convergence angles β, so an outlet orifice can have outer or first and third lip segments defined by first and third separate interior wall segments having a first selected interior wall convergence angle β1 (selected to be, e.g., 100-180 degrees, for interior wall segments 1 and 3, resulting in lips 1 and 3) while a second lip segment is defined by a second separate interior wall segment having a second selected interior wall convergence angle β2 (selected to be, e.g., 20-100 degrees) forming the center lip 2. Note that convergence angles for lips 1 and 3 are equal in this example, but could be different as well. In that case the three wall segments would define three convergence angles (β1, β2 and β3).

The exemplary embodiment here described is for three lips or lip segments, but the nozzle structure and method of the present invention can be extended to five or more lips, when there is a need to control distribution and spray angle. A nozzle with five lip segments could include five (5) separate and distinct selected interior wall convergence angles (β1-β5) each selected from the range of 20 to 180 degrees.

In accordance with the present invention, each lip segment defines an edge having its own lateral extent or width. In existing designs (e.g., prior art nozzle 30), each single lip (e.g., $L_1$ or $L_2$) has a width equal to the width of the feed lumen, Fw (as shown in FIGS. 1C, 1E, 1F). In the present invention, each lip segment has its own segment edge length (which are designated Fw1, Fw2, Fw3, etc., as if each segment were considered to comprise its own feed lumen). The transverse length defined by each lip segment is chosen to enable a uniform spray distribution for the entire exit orifice. In general, applicants' have found that for the subject high viscosity fluids (i.e., oils, sunscreen lotions, lotions, cleaning liquids, shear-thinning liquids and gels and similar fluids having viscosities of 10-100 cP) a surprisingly uniform spray fan can be generated with narrower or shorter outer lips and a wider or longer central lip, and with the central lip being defined more distally with a smaller interior wall convergence angle β than the outer lips. In one prototype, the transverse edge length of the central lip (lip 2) was selected to be 40%-60% of Fw and the transverse edge lengths of outer lips (lips 1 and 3) were 20-30% Fw, and this nozzle configuration was found to provide a significantly more uniform coating of the liquid spray. This prototype was one example having the outer lip segments (lips 1 and 3) defined with equal lengths, but those outer lip segments could be unequal and produce excellent spray results.

In operation, for the example nozzle described above, lip 1 and lip 3 have a high convergence angle (e.g., 150 degrees). This results in a larger spray angle on intersection, however since lips 1 and 3 have smaller widths compared to lip 2, lesser volume is at the edges of lips 1 and 3. The center lip (lip 2) has the largest width or edge length and the smallest convergence angle, resulting in a smaller fan and more volume in the center of the spray. The spray from this nozzle can be thought of as a superposition of three distinct spray fans, and the superposition of the three spray fans from the three lip segments results in a substantially more uniform volume distribution over the spray fan, when compared with prior art nozzle 30.

More generally, the multi-lip design of the present invention is now believed to provide several effective embodiments for flat fan spray nozzles which are especially well suited for spraying viscous fluids uniformly into spray fan pattern. The preferred embodiments comprise two to five lip segments, each having a selected edge length or width and interior wall convergence angle β. By controlling lip width and convergence angle, liquid streamlines intersect at varying angles resulting in a uniform spray distribution and so the nozzles of the present invention can provide a much more even coating over a surface.

In one embodiment of the invention, a cup-shaped viscous fluid flat fan spray generating nozzle member for spray-type dispensers has a substantially cylindrical sidewall surrounding a central longitudinal spray axis which intersects a transverse spray fan axis. The cup-shaped viscous fluid flat fan spray generating nozzle member's cylindrical sidewall terminates distally in a substantially circular distal end wall having an interior surface and an exterior, or distal, surface with a central outlet, or exit aperture, which provides fluid communication between the interior and exterior of the cup. Defined in the interior surface of the distal wall is an enhanced multi-lip flat fan spray generating structure which includes at least first and second contiguous regions defined by converging fluid feed channel wall segments converging at first and second interior wall convergence angles (β1, β2, each selected from the range of 20 to 180 degrees) to define first and second exit orifice lips or lip segments. Each exit orifice lip has a selected lip edge length or transverse width to define a portion of the exit orifice in the end wall.

With all of the foregoing embodiments, it is an object of the present invention to provide a cost effective substitute for traditional flat fan spray shear nozzle assemblies which will, for viscous products, reliably generate a substantially uniform flat fan spray.

BRIEF DESCRIPTION OF THE DRAWINGS

The foregoing, and additional objects, features, and advantages of the present invention will be further understood from the following detailed description of preferred embodiments thereof, taken with the following drawings, in which.

DESCRIPTION OF THE INVENTION

Figure 1A:
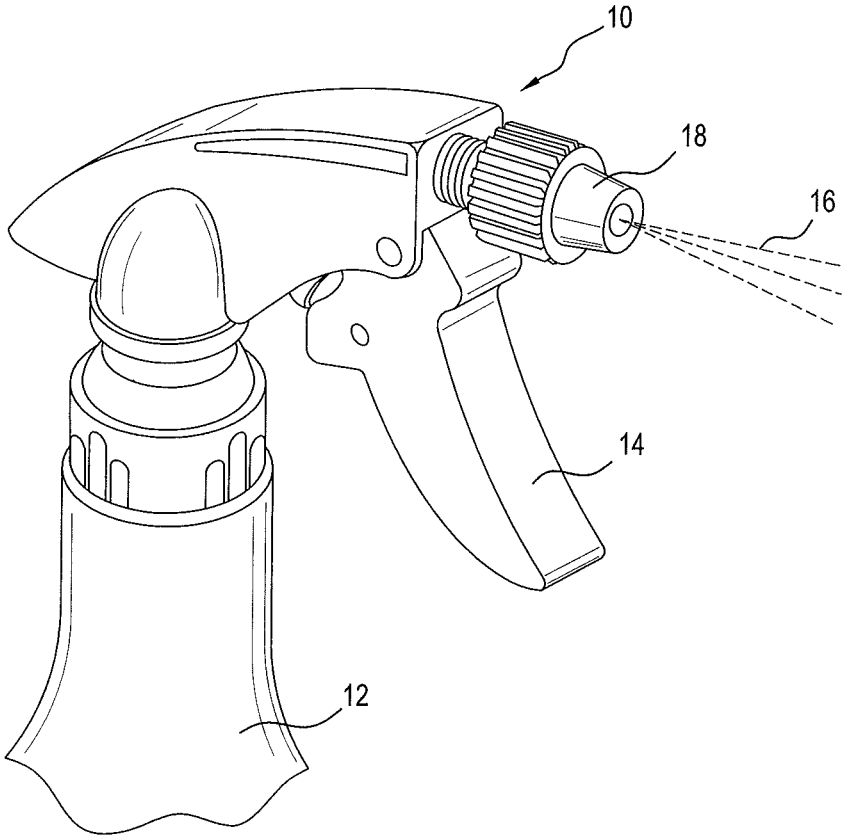
FIG. 1A (PRIOR ART)
FIG. 1A illustrates the spray head of a manual-trigger spray applicator in accordance with the prior art.

Referring now to the Figures, wherein common elements are identified by the same numbers, FIG. 1A illustrates a typical manually-operated trigger pump 10 secured to a container 12 of fluid to be dispensed, wherein the pump incorporates a trigger 14 activated by an operator to dispense fluid 16 through a nozzle 18. Such dispensers are commonly used, for example, to dispense a fluid from the container in a defined spray pattern or as a stream. Adjustable spray patterns may be provided so the user may select a stream or one of a variety of sprayed fluid droplets. A typical nozzle 18 consists of tubular conduit that receives fluid from the pump and directs it into a spray head portion, where the fluid travels through channels and is ejected from orifice, or aperture 28. Such devices are constructed as a one-piece molded plastic "cap" with channels that line up with the pump outlet to produce the desired stream or spray of a variety of fluids at pressures generally in the range of 30 to 40 PSI, if spraying a fluid which is not significantly more viscous than water.

Figure 1B:
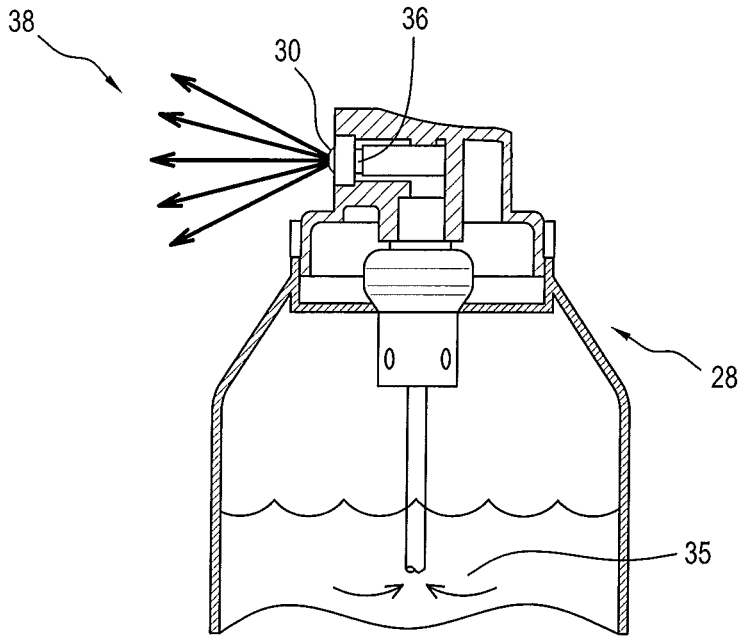
FIG. 1B (PRIOR ART)
FIG. 1B illustrates typical features of a prior art aerosol spray actuator having a traditional flat fan spray shear nozzle.
Figure 1C:
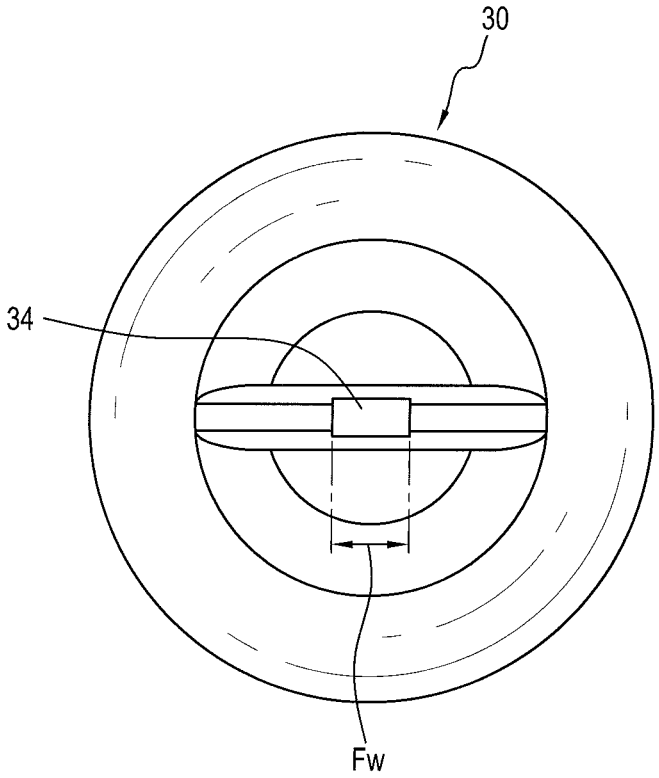
FIG. 1C (PRIOR ART)
FIGS. 1C-1F illustrate typical features of a prior art flat fan spray shear nozzle member's internal geometry and exit orifice geometry.
Figure 1D:
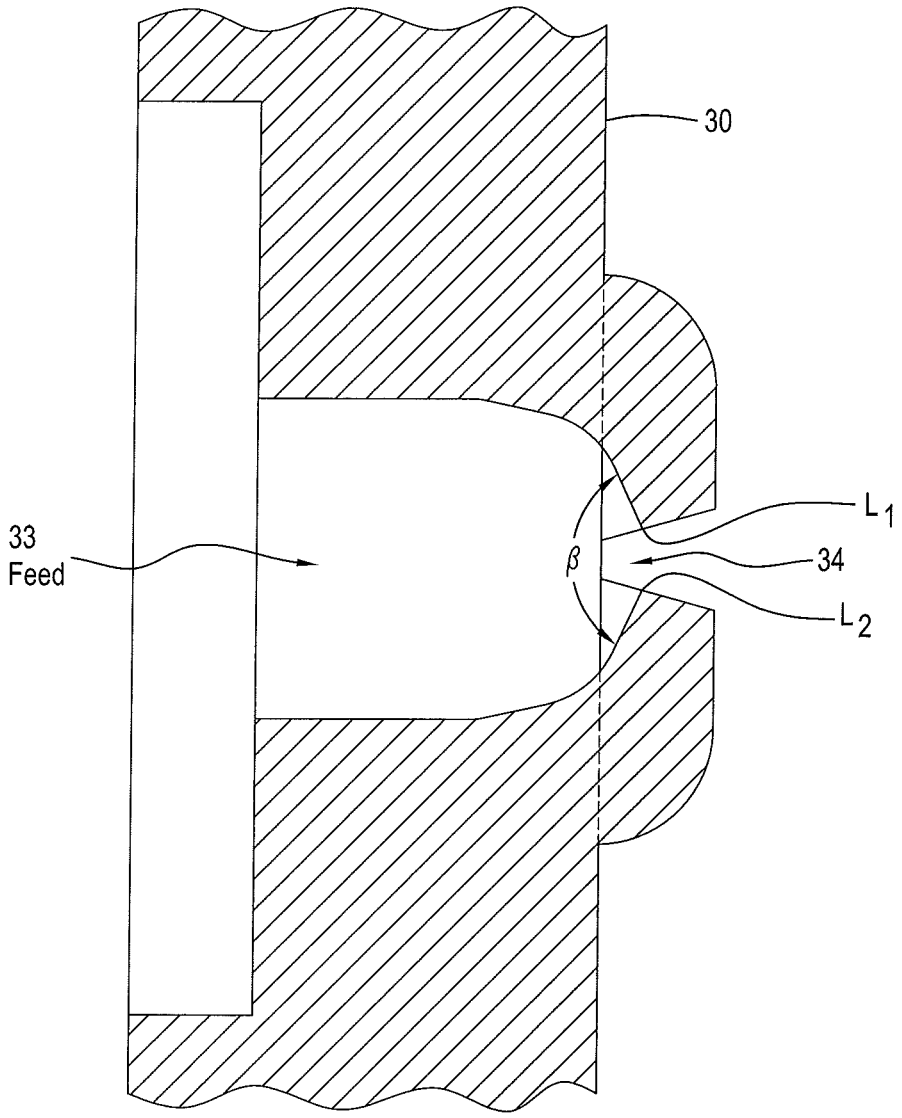
FIG. 1D (PRIOR ART)

FIGS. 1B and 1C illustrate a typical commercial aerosol dispenser 28 configured with a traditional flat fan spray nozzle member configured as a cup shaped member 30. These standard cup-shaped nozzle members 30 have an interior surface which abuts and seals against a face seal on a planar circular surface of distally projecting sealing post 36 and is arranged so that the flow of product fluid 35 flows into and through an annular lumen into the fluid feed or input channel 33 and then flows distally into the central converging region 35. The fluid product flows distally or downstream and leaves the converging region 35 through an exit orifice 34 which is typically concentric to the central axis of the sealing post 36. For viscous liquid products, the fluid product spray 38 issuing from or generated by the standard nozzle assembly sprays a non-uniform pattern of liquid droplets as described above. These viscosity dependent problems were analyzed by the applicants, who have discovered that parts of the standard nozzle assemblies of the spray dispensers 10, 28 can be used for spraying viscous products, but only if a newly developed nozzle configuration is also used.

To overcome the problems found in prior art sprayers of FIGS. 1A-1F, in accordance with the present invention, a new nozzle assembly is configured for use with the spray head and sealing post structure of standard nozzle assemblies, but discards the flawed performance of the standard cup-shaped nozzle member (e.g., 30). Thus, the present invention is directed to a new nozzle configuration, illustrated in FIGS. 2-7, which permits significantly improved control of the subject high viscosity fluids (i.e., oils, sunscreen lotions, other lotions, cleaning liquids, shear-thinning liquids and gels and similar Newtonian and non-Newtonian fluids having viscosities of 10-100 cP) and permits the configuration of a flat fan spray generating nozzle which will generate substantially uniform spray density over the entire width of the spray fan.

Figure 1E:
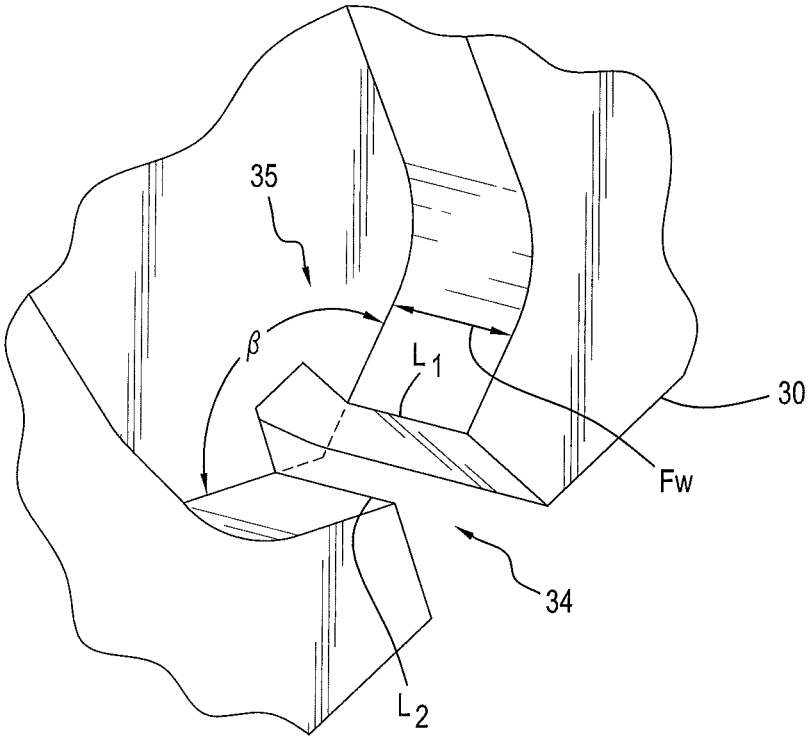
FIG. 1E (PRIOR ART)
Figure 1F:
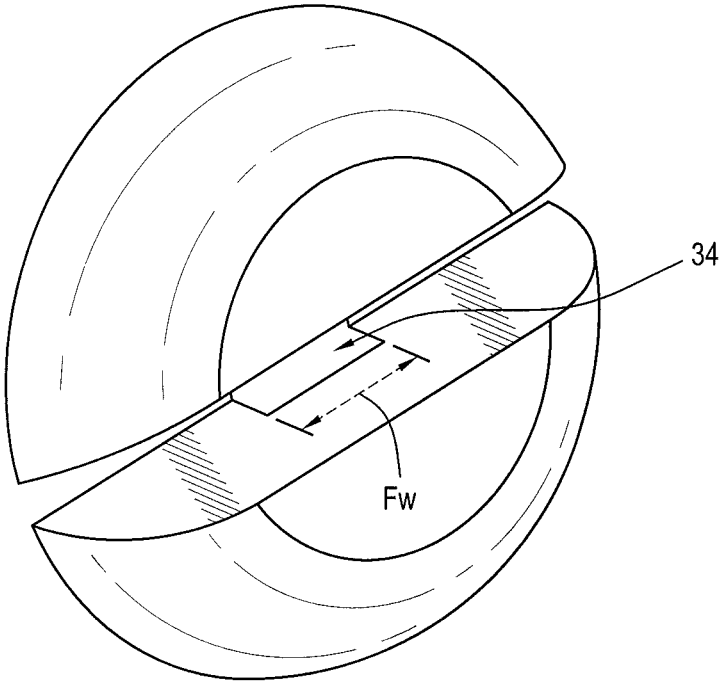
FIG. 1F (PRIOR ART)
Figure 2:
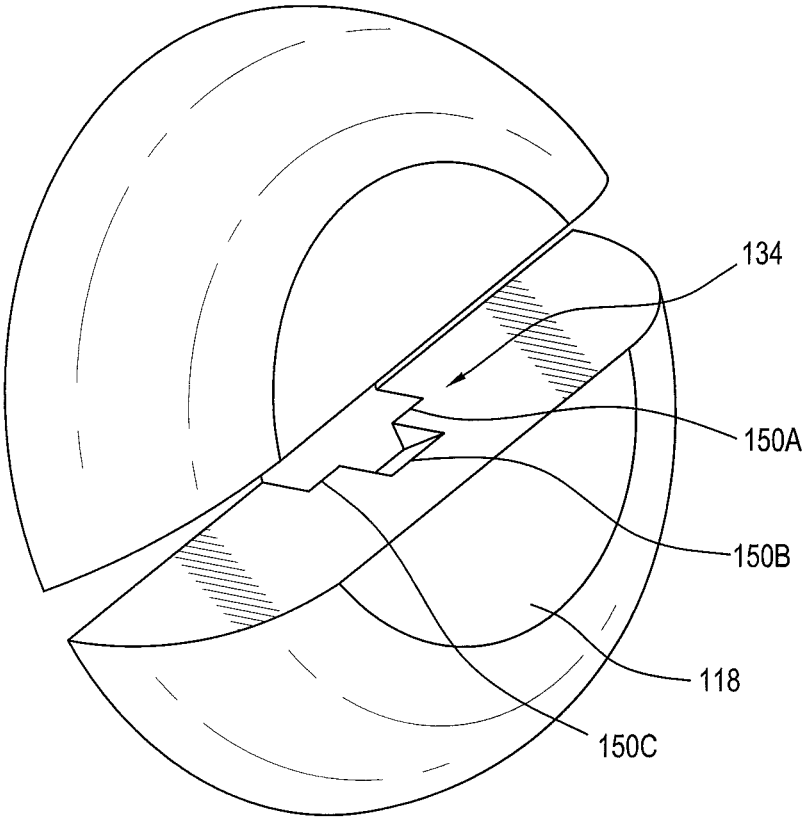
FIG. 2 is a shaded perspective view, in elevation, illustrating a viscous fluid flat fan spray generating nozzle member's distal end wall and exit aperture which defines an enhanced multi-lip flat fan spray generating structure comprising first, second and third exit orifice lips or lip segments, in accordance with the present invention.

Referring initially to FIG. 2, and comparing this to prior art FIG. 1F, new exit orifice 134 has a crenellated appearance with plural distinct, discontinuous shear inducing edge segments or lips 150A, 150B, 150C, defining the exit orifice 134 with multiple lip surfaces instead of a single continuous lip edge (e.g., FIG. 1F's lips $L_1$ or $L_2$). Applicants' new multi-lip configuration enables significantly enhanced control of spray volume distribution, and is especially well suited for controlling the distribution of liquid volume across the spray fan for high viscosity liquids.

Figure 7:
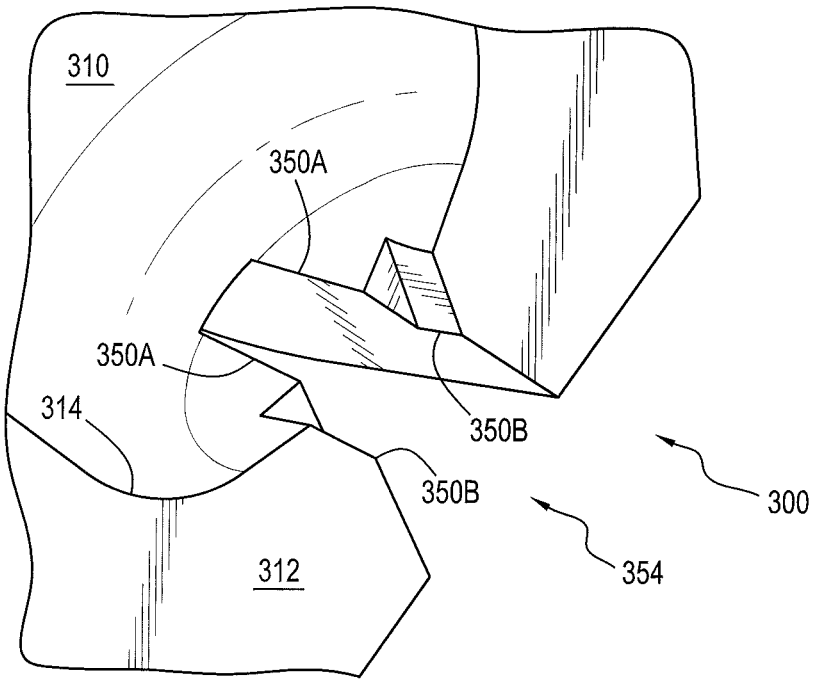
FIG. 7 is a shaded perspective cut-away view, in elevation, of an alternative nozzle member illustrating a tubular or circular sectioned feed lumen and central exit aperture (shown split along the central axis), showing first and second converging wall segments terminating in first and second exit orifice lips or lip segments, in accordance with the present invention.

Referring next to three views of a cup-shaped viscous fluid flat fan spray generating nozzle member 100 configured for use with for spray-type dispensers (e.g., as shown in FIG. 1A or 1B) subject viscous fluid product flows into and through a rectangular feed channel 110 having a lumen height Fh and a lumen width Fw. Flow in the feed lumen 110 is directed distally or downstream to exit orifice 134 by planar, parallel side walls and converging top and bottom walls. In the prior art nozzles (e.g., 30) the exit orifice (e.g., 34) is characterized by an aperture defined between opposing single continuous lips (e.g., $L_1$, $L_2$) each defined at the distal end of a top or bottom wall segment having one angle or convergence β1 (Beta, best seen in FIGS. 1D and 1E). While this invention is described in these exemplary embodiments as used with a rectangular feed lumen 110, the multi lip exit orifice of the present invention 134 can also be used with a circular or elliptical cross section feed lumen (as illustrated in FIG. 7, to be described further below).

Figure 5:
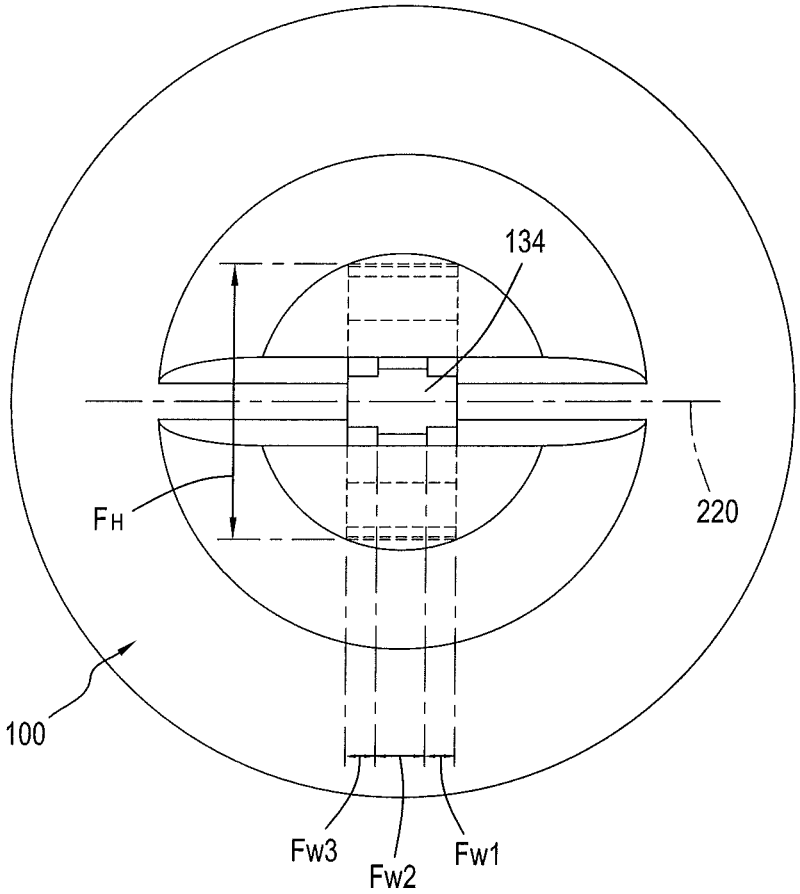
FIG. 5 is a detailed or magnified diagram illustrating the geometry of the features of the nozzle member of FIGS. 2-3C, as imagined from a distal end view like FIG. 3C showing the exit orifice's central placement at the intersection of the nozzle member's central spray axis and transverse flat fan axis and showing, in hidden line, the rectangular feed channel's converging wall segments, in accordance with the present invention.

Cup-shaped viscous fluid flat fan spray generating nozzle member 100 has a substantially cylindrical sidewall 102 surrounding a central longitudinal spray axis 120 which intersects a transverse spray fan axis 220. The cup-shaped viscous fluid flat fan spray generating nozzle member's cylindrical sidewall 102 has an open proximal end 104 defining the upstream end of an interior volume 106. Nozzle member sidewall 102 terminates distally in a substantially circular distal end wall 112 having an interior surface 114 and an exterior, or distal, surface 116 with a central outlet or exit aperture 134 which provides fluid communication between the interior 106 and exterior of the cup shaped nozzle member 100. There may be more than one exit orifice in a nozzle assembly or for use with a dispenser, but for purposes of describing the nozzle geometry of the present invention, the exemplary nozzle member 100 including at least a first shear nozzle exit orifice 134 passing through distal end wall 112, and that exit orifice is coaxially aligned with first central longitudinal spray axis 120 and provides fluid communication between said nozzle member's interior fluid channel 106 and the ambient space beyond the distal end wall 116. As best seen in FIG. 5, exit orifice 134 is elongated or substantially rectangular with the orifice's larger internal diameter dimension being aligned with the transverse "V-shaped groove" defining distal surface exit angle α and aligned with the transverse spray axis 220 which intersects the central longitudinal spray axis 120.

Defined in the interior surface 114 of the distal wall 112 is an enhanced multi-lip flat fan spray generating structure which includes plural (at least first and second, but, in the illustrated embodiment, first, second and third) distinct, contiguous fluid feed channel wall segments converging at plural (e.g., first and second interior wall convergence angles (β1, β2, each selected from the range of 20 to 180 degrees) to define plural exit orifice lips or lip segments (e.g., 150A, 150B, 150C. Each exit orifice lip has a selected lip edge length or transverse width to define a portion of the exit orifice 134 in the end wall 112.

In the configuration seen in FIGS. 3A-5, internal threads (not shown) may optionally be included in an internal surface of sidewall 102 at the inlet side or open proximal end 104 the nozzle member 100. The internal threads (if included) are configured to engage with external threads 53 located on the distal end of a discharge of nozzle body 10. Various other mechanical methods of connecting the nozzle member 100 to a dispenser may be used. For example, an alternative method of connecting the nozzle member may be a snap fit type connection.

The distal or exit side or surface 116 of distal wall 112 has distally projecting boss 118 with transverse "V-shaped" groove 119 cut therethrough which intersects the interior forming the elongated exit orifice 134. Transverse "V-shaped" groove 119 defines a pair of angled inside surfaces symmetrically arranged about and spaced from transverse spray axis 220, and the groove's inside surfaces define an exit angle α (alpha), which is (in the illustrated example) 30 degrees. During a dispensing cycle of a spray delivery system using nozzle member 100 it is the transition of the internal feed lumen 110 the interior surface features defining exit orifice 134 that causes the convergence of the fluid streamlines toward the elongated orifice 134 at high stream velocities when the fluid is forced through the spray nozzle member 100. The multi-lipped geometry of exit orifice 134 forces the fluid streamlines to form a plurality or flat liquid sheets oriented parallel to transverse axis 220 upon exiting or being dispensed from the confines of the spray nozzle member 100. External to the spray nozzle member 100 the fluid flowing over each lip segment (e.g., 150A, 150B and 150C) form ligaments and thereafter droplets which disperse or disintegrate into a fan shaped atomized spray pattern (not shown) aligned along transverse axis 220.

Generally, this fan spray pattern (not shown) consists of dispersed droplets of fluid arranged such that a transverse cross-section of the fan spray pattern would be elongated, elliptical, or oblong in shape. The dispersed droplets of fluid may be finely dispersed, such as an atomized spray, or even more coarsely dispersed representing larger droplets of fluid. When this fan spray pattern contacts a surface intended to be coated with the fluid, a substantially uniform coating of fluid is produced having a substantially linear elongated shape.

Figure 3C:
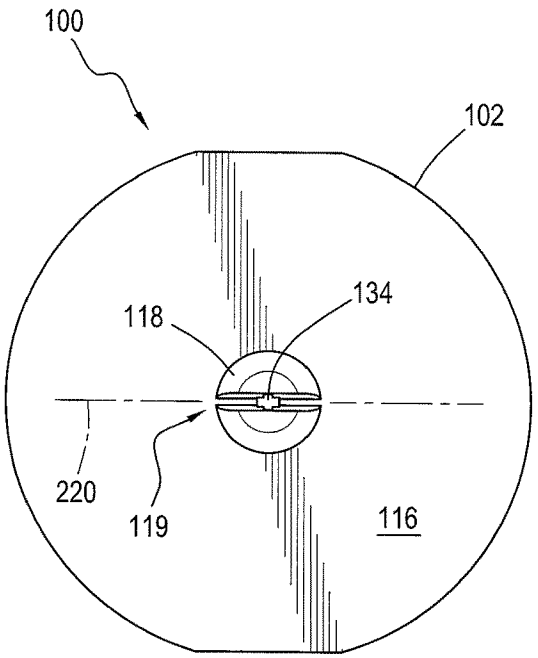
FIG. 3C is a distal end view, in elevation illustrating the distal end surface and exit orifice of the cup-shaped viscous fluid flat fan spray generating nozzle member of FIG. 3A, in accordance with the present invention.
Figure 3B:
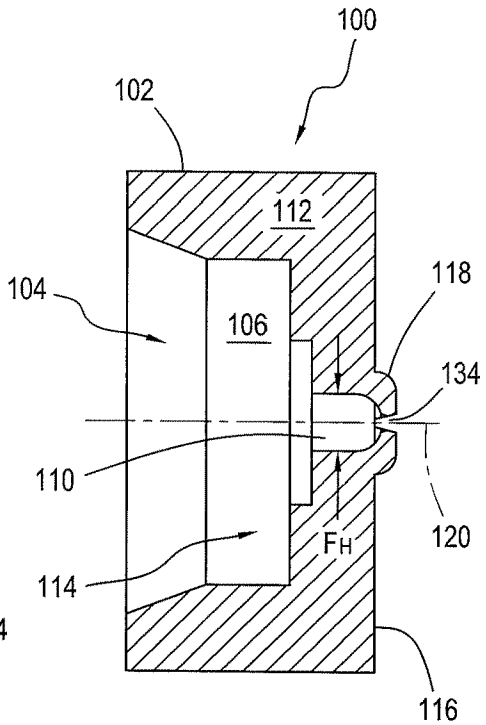
FIG. 3B is a side view, in elevation, illustrating the side cross section of the cup-shaped viscous fluid flat fan spray generating nozzle member of FIG. 3A, in accordance with the present invention.
Figure 3A:
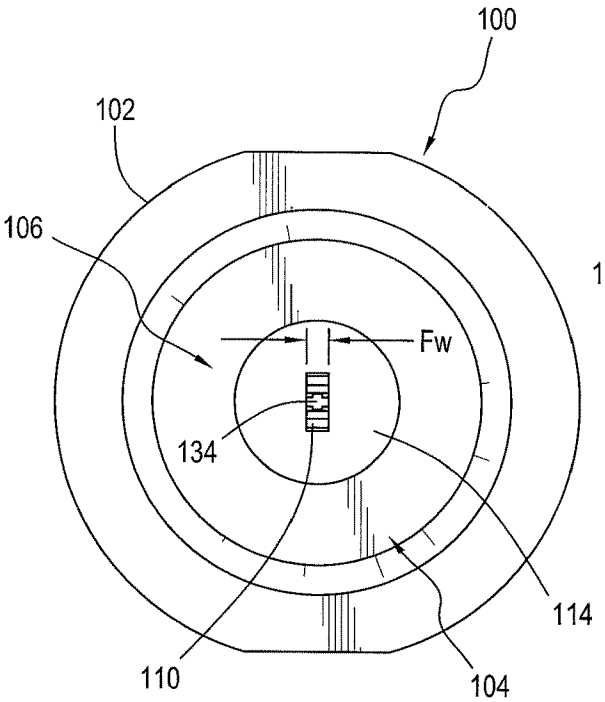
FIG. 3A is rear or proximal open end view, in elevation of a cup-shaped viscous fluid flat fan spray generating nozzle member with a substantially cylindrical sidewall surrounding a central longitudinal spray axis which intersects a transverse spray fan axis; the nozzle member's cylindrical sidewall terminates distally in a substantially circular distal end wall having an interior surface with a central exit aperture, and the interior surface of the distal wall includes is an enhanced multi-lip flat fan spray generating structure which includes three separate contiguous regions defined by converging fluid feed channel wall segments converging at selected interior wall convergence angles to define the three lips or lip segments of FIG. 2, in accordance with the present invention.
Figure 6:
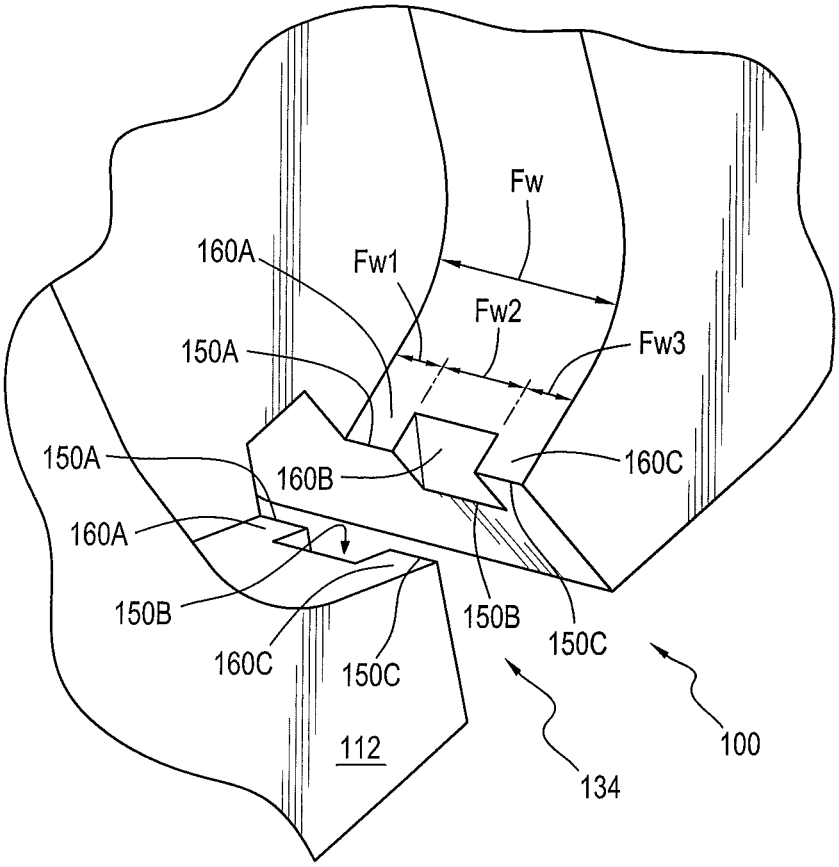
FIG. 6 is a shaded perspective cut-away view, in elevation, of the nozzle member of FIGS. 2-3C illustrating the rectangular feed lumen and exit aperture, including the first, second and third converging wall segments terminating in first, second and third exit orifice lips or lip segments, in accordance with the present invention.

FIGS. 3C and 6 depict the "V-shaped" groove 119 on the exterior surface 116 of nozzle member 100. As noted above, "V-shaped" groove 119 has an angle α (alpha), which represents the average included angle of the groove measured along the major diameter of the elongated orifice 134 which is parallel with transverse spray axis 220. As defined herein, the angle α will of necessity be some value between about 0° and 180°, with the 0° representing a slot with spaced parallel sides and 180° representing no groove 119 at the exit orifice on the distal or exit side 116. The angle α is preferably, is from about 20° to about 90°; more preferably, from about 30° to about 50°; and most preferably about 30°. It has been found that a triangular prismatic or "V-shaped" groove 119 and a converging 114 or hemispherical 314 interior surface in fluid communication with a liquid inlet lumen 110 work well to produce the liquid sheet which generates the desired flat fan spray pattern.

The multi-lip configuration of nozzle member 100 enables significantly enhanced control of spray volume distribution, and is especially well suited for controlling the distribution of liquid volume across the spray fan for high viscosity liquids. In an exemplary embodiment, fluid flow enters through rectangular feed channel or lumen 110, and the fluid is forced or directed distally or downstream to exit orifice 134 between the planar, parallel side walls and converging top and bottom walls of feed lumen 110. At distal end wall 112, exit orifice 134 is bounded by multiple separate discontinuous lips or edges (e.g., 150A, 150B, 150C). These separate or discontinuous lips are each formed at the distal end of separate and distinct interior wall segments (160A, 160B, 160C) having selected convergence angles β, so in the example illustrated in FIGS. 2-6, outlet orifice 134 has outer or first and third lip segments (150A, 150C) defined by first and third separate interior wall segments having a first selected interior wall convergence angle β1 (selected to be, e.g., 100-180 degrees, for interior wall segments 160A and 160C, which terminate distally at the orifice resulting in lips 150A and 150C) while a second, central lip segment 150B is defined by a second separate interior wall segment 160B having a second selected interior wall convergence angle β2 (selected to be, e.g., 20-100 degrees) which terminates distally at the orifice to form the center lip 150B. Note that convergence angles for the outer lips 150A and 150C are equal in this example, but could be different as well. In that case the three wall segments 160A, 160B, 160C would define three convergence angles (β1, β2 and β3).

The exemplary embodiment here described is for three lips or lip segments 150A, 150B, 150C, but the nozzle structure and method of the present invention can be extended to five or more lips, when there is a need to control distribution and spray angle with greater resolution. A nozzle with five lip segments could include five (5) separate and distinct selected interior wall convergence angles (β1-β5) each selected from the range of 20 to 180 degrees.

In accordance with the present invention, each lip segment defines an edge having its own lateral extent or width. In existing designs (e.g., prior art nozzle 30), each single lip (e.g., $L_1$ or $L_2$) has a width equal to the width of the feed lumen, Fw (as shown in FIGS. 1C, 1E, 1F). In the present invention as illustrated in FIGS. 2-7, each lip segment (e.g., 150A, 150B, 150C) has its own segment edge length (which are designated Fw1, Fw2, Fw3, (best seen in FIGS. 5 and 6), as if each segment were considered to comprise its own feed lumen). The transverse length defined by each lip segment (e.g., Fw1, Fw2 or Fw3) is chosen to enable a uniform spray distribution for the entire exit orifice 134. In general, applicants' have found that for the subject high viscosity fluids (i.e., oils, sunscreen lotions, other lotions, cleaning liquids, shear-thinning liquids and gels and similar fluids having viscosities of 10-100 cP) a surprisingly uniform spray fan (not shown) can be generated with narrower or shorter outer lips (e.g., 150A and 150C) and a wider or longer central lip (e.g., 150B), and with the central lip being 150B defined with an edge that is more distally oriented (i.e., closer to external wall surface of distally projecting boss 118) with a smaller interior wall convergence angle β than the outer lips (as best seen in FIG. 2). In one prototype, the transverse edge length of the central lip (150B) was selected to be 40%-60% of the total feed width Fw and the transverse edge lengths of outer lips (150A and 150C) were 20-30% Fw, and this nozzle configuration was found to provide a significantly more uniform coating of the liquid spray. This prototype was one example having the outer lip segments (150A and 150C) defined with equal lengths, but those outer lip segments could be unequal and produce excellent spray results.

Figure 4:
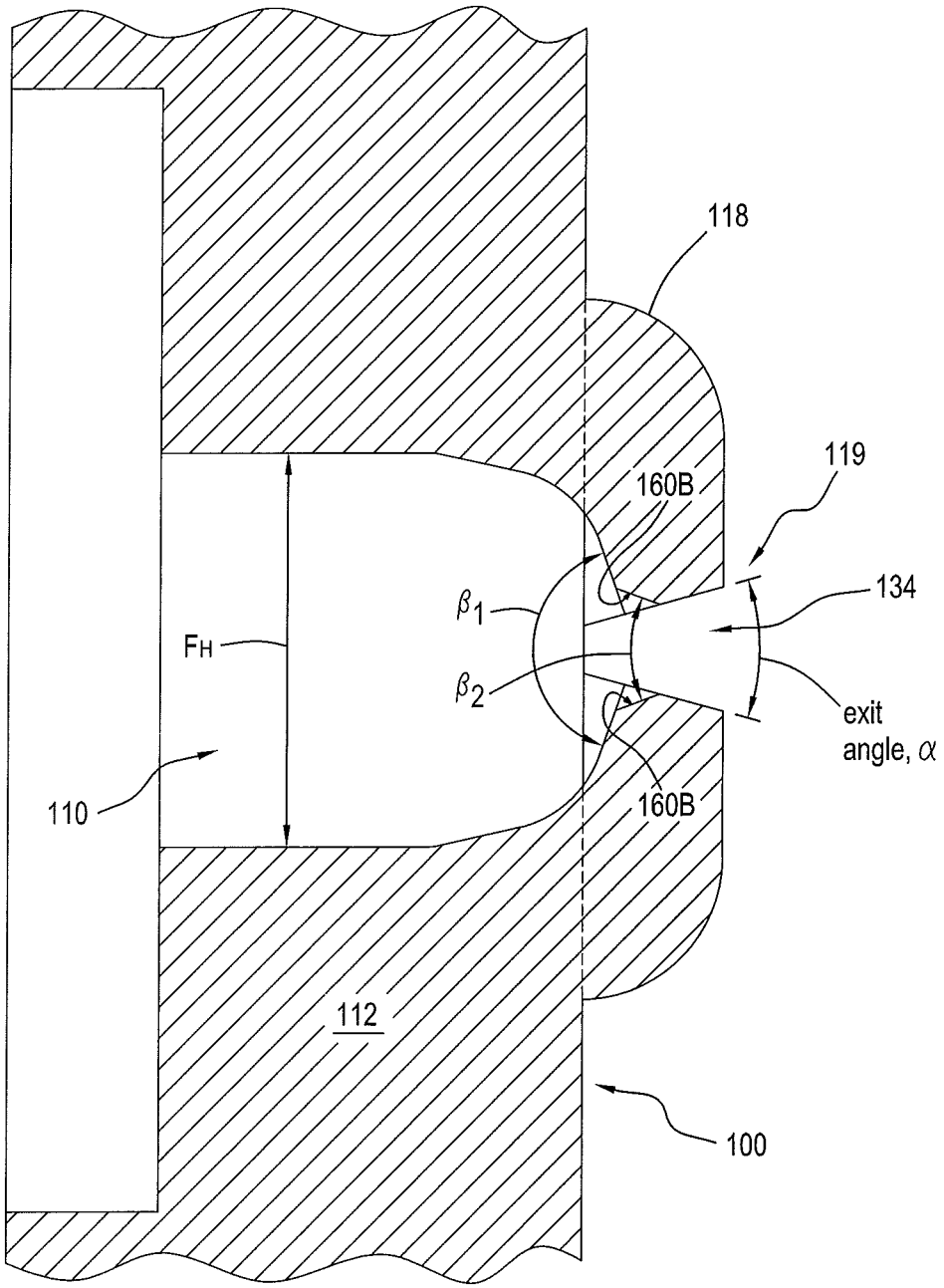
FIG. 4 is a diagram illustrating the geometry of the features of the nozzle member of FIGS. 2-3C as imagined from a side view like FIG. 3B showing the outer fluid feed channel wall segments' convergence angle β1 and the central fluid feed channel wall segment convergence angle β2 symmetrically configured about the nozzle member's central spray axis, in accordance with the present invention.

In operation, for the example nozzle described above, outer lips 150A and 150C have a high convergence angle (e.g., β1=150 degrees, see FIG. 4). This results in a larger spray angle on intersection, however since outer lips 150A and 150C have smaller widths compared to lip 150B, lesser volume flows past the edges of lips 150A and 150C. The center lip (150B) preferably has the largest width or edge length Fw2 and the smallest convergence angle β2, resulting in a smaller fan and more volume in the center of the spray. The spray from nozzle member 100 can be thought of as a superposition of three distinct spray fans, and the superposition of the three spray fans from the three lip segments results in a substantially more uniform volume distribution over the spray fan, when compared with prior art nozzle (e.g., 30).

More generally, the multi-lip design of the present invention is now believed to provide several effective embodiments for flat fan spray nozzles which are especially well suited for spraying viscous fluids uniformly into spray fan pattern. The preferred embodiments comprise two to five lip segments (e.g., 150A, 150B, 150C), each having a selected edge length or width (e.g., Fw1, Fw2, Fw3) and interior wall convergence angle β. By controlling lip width and convergence angle, liquid streamlines intersect at varying angles resulting in a uniform spray distribution and so the nozzles of the present invention can provide a much more even coating over a surface when spraying the subject high viscosity fluids (i.e., oils, sunscreen lotions, other lotions, cleaning liquids, shear-thinning liquids and gels and similar Newtonian and non-Newtonian fluids having viscosities of 10-100 cP).

Spray or exit orifice 134 is defined by first and second crenellated or discontinuous edges having symmetrically arrayed and aligned lip segments (e.g., 150A, 150B, 150C), as shown in FIGS. 3A, and 4-6. In the illustrated prototype, each lip segment is symmetrically aligned with a mirror image lip segment, where both are equally spaced from transverse axis 220.

As noted above, alternative embodiments are envisioned. For example, FIG. 7 illustrates the internal details for a cut away of a nozzle member, 300, where the feed channel is not rectangular, but is instead substantially circular. The interior surface 314 defined in distal end wall 312 is dome shaped, that is, resembling or shaped like a substantially hemispherical vault or in the form of a portion of a substantially spherical shape. The interior surface 314 a hemispherical diameter that is substantially equal to the diameter of fluid feed channel inlet lumen 310, and outlet orifice 334 is defined by multiple lips (e.g., 350A and 350B) to provide the same advantages described with regard to nozzle member 100, above.

Having described preferred embodiments of new and improved nozzle configurations and methods for generating uniform sprays of viscous fluids, it is believed that other modifications, variations and changes will be suggested to those skilled in the art in view of the teachings set forth herein. It is therefore to be understood that all such variations, modifications and changes are believed to fall within the scope of the present invention as set forth in the appended claims.

What is claimed is:

1. A spray nozzle configured to generate a uniform flat fan spray along a transverse spray axis when spraying Newtonian or non-Newtonian viscous fluids, comprising:

a shear nozzle member defined around a first central longitudinal spray axis and having a side wall enclosing an interior volume defining a fluid channel and having a proximal open lumen end opposing a closed distal end wall;

said nozzle member including at least a first shear nozzle exit orifice passing through said distal end wall, said first shear nozzle exit orifice being coaxially aligned with said first central longitudinal spray axis and providing fluid communication between said fluid channel and the ambient space beyond the distal end wall;

said exit orifice being elongated or substantially rectangular with the orifice's larger internal diameter dimension being aligned with a transverse V-shaped groove defined by a pair of angled inside surfaces having a distal surface exit angle α and aligned with the transverse spray axis which intersects the central longitudinal spray axis;

said fluid channel terminating distally in an interior surface of said distal end wall including a plurality of converging wall segments which terminate in said shear nozzle exit orifice to define a plurality of wall edge or lip segments;

wherein each converging wall segment defines an interior fluid channel surface which intersects the shear nozzle exit orifice at a selected convergence angle β;

wherein each distal edge of the converging wall segment defines an orifice lip segment with a selected lip width or transverse length;

wherein said plurality of converging wall segments comprise a first converging wall segment and a second converging wall segment;

wherein said first converging wall segment terminates in said shear nozzle exit orifice to define a first wall edge or lip segment and defines an interior fluid channel surface which intersects the shear nozzle exit orifice at a first selected convergence angle β1 and said distal edge of the first converging wall segment defines a first orifice lip segment with a first selected lip width or transverse length $F_1W$; and wherein said second converging wall segment terminates in said shear nozzle exit orifice to define a second wall edge or lip segment and defines another interior fluid channel surface which intersects the shear nozzle exit orifice at a second selected convergence angle β2 which is unequal to first selected convergence angle β1, and wherein said distal edge of the second converging wall segment defines a second orifice lip segment with a second selected lip width or transverse length $F_2W$ which may be equal to or unequal to said first selected lip width $F_1W$.

2. The spray nozzle of claim 1, wherein each of said plurality of converging wall segments define an interior fluid channel surface which intersects the shear nozzle exit orifice at a selected convergence angle β, said selected convergence angle β being selected to be an angle which is at least 20 degrees and not greater than 180 degrees.

3. The spray nozzle of claim 2, wherein said plurality of converging wall segments additionally include a third converging wall segment;

wherein said third converging wall segment terminates in said shear nozzle exit orifice to define a third wall edge or lip segment and defines another interior fluid channel surface which intersects the shear nozzle exit orifice at a third selected convergence angle β3 which is may be equal to or unequal to said first selected convergence angle B1, and wherein said distal edge of the third converging wall segment defines a third exit orifice lip segment with a third selected lip width or transverse length $F_3W$ which may be equal to or unequal to said first selected lip width $F_1W$.

4. The spray nozzle of claim 2, wherein said first and third lip segments define outer lip segments and said second lip segment defines a central lip segment between and contiguously abutting said first and third lip segments and wherein said second lip width is selected to comprise 10%-70% of a feed width, $F_w$ of the exit orifice.

5. The spray nozzle of claim 3, further comprising a fourth converging wall segment wherein said fourth converging wall segment terminates in said shear nozzle exit orifice to define a fourth wall edge or lip segment and defines another interior fluid channel surface which intersects the shear nozzle exit orifice at a fourth selected convergence angle β4 which may be equal to or unequal to said first selected convergence angle β1, and wherein said distal edge of the fourth converging wall segment defines a fourth exit orifice lip segment with a fourth selected lip width or transverse length $F_4W$ which may be equal to or unequal to said first selected lip width $F_1W$.

6. The spray nozzle of claim 5, further comprising a fifth converging wall segment wherein said fifth converging wall segment terminates in said shear nozzle exit orifice to define a fifth wall edge or lip segment and defines another interior fluid channel surface which intersects the shear nozzle exit orifice at a fifth selected convergence angle β5 which may be equal to or unequal to said first selected convergence angle β1, and wherein said distal edge of the fifth converging wall segment defines a fifth exit orifice lip segment with a fifth selected lip width or transverse length $F_5W$ which may be equal to or unequal to said first selected lip width $F_1W$.

7. The spray nozzle of claim 1, wherein said exit angle α is selected to be at least 10 degrees and no greater than 90 degrees.

8. The spray nozzle of claim 1, wherein said fluid channel has a substantially rectangular cross section with a lumen area defined by parallel sidewalls separated by a feed width Fw and having a sidewall height of Fh at said inlet's proximal open end; and wherein said lip segment widths combine to define said exit orifice width which is equal to the feed width Fw.

9. The spray nozzle of claim 1, wherein said fluid channel has a substantially circular or elliptical cross section and a feed width Fw and wherein said lip segment widths combine to define said exit orifice width which is equal to the feed width Fw.

10. A spray nozzle configured to generate a uniform flat fan spray along a transverse spray axis when spraying Newtonian or non-Newtonian viscous fluids, comprising:

a shear nozzle member defined around a first central longitudinal spray axis and having a side wall enclosing an interior volume defining a fluid channel and having a proximal open lumen end opposing a closed distal end wall;

said nozzle member including at least a first shear nozzle exit orifice passing through said distal end wall, said first shear nozzle exit orifice being coaxially aligned with said first central longitudinal spray axis and providing fluid communication between said fluid channel and the ambient space beyond the distal end wall;

said exit orifice being elongated or substantially rectangular with the orifice's larger internal diameter dimension being aligned with a transverse V-shaped groove defined by a pair of angled inside surfaces having a distal surface exit angle α and aligned with the transverse spray axis which intersects the central longitudinal spray axis;

said fluid channel terminating distally in an interior surface of said distal end wall including a plurality of converging wall segments which terminate in said shear nozzle exit orifice to define a plurality of wall edge or lip segments;

wherein each converging wall segment defines an interior fluid channel surface which intersects the shear nozzle exit orifice at a selected convergence angle β;

wherein each distal edge defines an orifice lip segment with a selected lip width or transverse length;

wherein said fluid channel has a substantially rectangular cross section with a lumen area defined by parallel sidewalls separated by a feed width Fw and having a sidewall height of Fh at said inlet's proximal open end; and wherein said lip segment widths combine to define said exit orifice width which is equal to the feed width Fw.

11. The spray nozzle of claim 10, wherein said plurality of converging wall segments comprise a first converging wall segment and a second converging wall segment;

wherein said first converging wall segment terminates in said shear nozzle exit orifice to define a first wall edge or lip segment and defines an interior fluid channel surface which intersects the shear nozzle exit orifice at a first selected convergence angle β1 and said distal edge of the first converging wall segment defines a first orifice lip segment with a first selected lip width or transverse length $F_1W$; and wherein said second converging wall segment terminates in said shear nozzle exit orifice to define a second wall edge or lip segment and defines another interior fluid channel surface which intersects the shear nozzle exit orifice at a second selected convergence angle β2 which is unequal to first selected convergence angle β1, and wherein said distal edge of the second converging wall segment defines a second orifice lip segment with a second selected lip width or transverse length $F_2W$ which may be equal to or unequal to said first selected lip width $F_1W$.

12. The spray nozzle of claim 11, wherein each of said plurality of converging wall segments define an interior fluid channel surface which intersects the shear nozzle exit orifice at a selected convergence angle β, said selected convergence angle β being selected to be an angle which is at least 20 degrees and not greater than 180 degrees.

13. The spray nozzle of claim 12, wherein said plurality of converging wall segments additionally include a third converging wall;

wherein said third converging wall segment terminates in said shear nozzle exit orifice to define a third wall edge or lip segment and defines another interior fluid channel surface which intersects the shear nozzle exit orifice at a third selected convergence angle β3 which is may be equal to or unequal to said first selected convergence angle B1, and wherein said distal edge of the third converging wall segment defines a third exit orifice lip segment with a third selected lip width or transverse length $F_3W$ which may be equal to or unequal to said first selected lip width $F_1W$.

14. The spray nozzle of claim 12, wherein said first and third lip segments define outer lip segments and said second lip segment defines a central lip segment between and contiguously abutting said first and third lip segments and wherein said second lip width is selected to comprise 10%-70% of a feed width, $F_w$ of the exit orifice.

15. The spray nozzle of claim 13, further comprising a fourth converging wall segment wherein said fourth converging wall segment terminates in said shear nozzle exit orifice to define a fourth wall edge or lip segment and defines another interior fluid channel surface which intersects the shear nozzle exit orifice at a fourth selected convergence angle β4 which may be equal to or unequal to said first selected convergence angle β1, and wherein said distal edge of the fourth converging wall segment defines a fourth exit orifice lip segment with a fourth selected lip width or transverse length $F_4W$ which may be equal to or unequal to said first selected lip width $F_1W$.

16. The spray nozzle of claim 15, further comprising a fifth converging wall segment wherein said fifth converging wall segment terminates in said shear nozzle exit orifice to define a fifth wall edge or lip segment and defines another interior fluid channel surface which intersects the shear nozzle exit orifice at a fifth selected convergence angle β5 which may be equal to or unequal to said first selected convergence angle β1, and wherein said distal edge of the fifth converging wall segment defines a fifth exit orifice lip segment with a fifth selected lip width or transverse length $F_5W$ which may be equal to or unequal to said first selected lip width $F_1W$.

17. The spray nozzle of claim 10, wherein said exit angle $\alpha$ is selected to be at least 10 degrees and no greater than 90 degrees.

18. A spray nozzle configured to generate a uniform flat fan spray along a transverse spray axis when spraying Newtonian or non-Newtonian viscous fluids, comprising:

a shear nozzle member defined around a first central longitudinal spray axis and having a side wall enclosing an interior volume defining a fluid channel and having a proximal open lumen end opposing a closed distal end wall;

said nozzle member including at least a first shear nozzle exit orifice passing through said distal end wall, said first shear nozzle exit orifice being coaxially aligned with said first central longitudinal spray axis and providing fluid communication between said fluid channel and the ambient space beyond the distal end wall;

said exit orifice being elongated or substantially rectangular with the orifice's larger internal diameter dimension being aligned with a transverse V-shaped groove defined by a pair of angled inside surfaces having a distal surface exit angle $\alpha$ and aligned with the transverse spray axis which intersects the central longitudinal spray axis;

said fluid channel terminating distally in an interior surface of said distal end wall including a plurality of converging wall segments which terminate in said shear nozzle exit orifice to define a plurality of wall edge or lip segments;

wherein each converging wall segment defines an interior fluid channel surface which intersects the shear nozzle exit orifice at a selected convergence angle $\beta$;

wherein each distal edge defines an orifice lip segment with a selected lip width or transverse length; and wherein said fluid channel has a substantially circular or elliptical cross section and a feed width Fw and wherein said lip segment widths combine to define said exit orifice width which is equal to the feed width Fw.

19. The spray nozzle of claim 18, wherein said plurality of converging wall segments comprise a first converging wall segment and a second converging wall segment;

wherein said first converging wall segment terminates in said shear nozzle exit orifice to define a first wall edge or lip segment and defines an interior fluid channel surface which intersects the shear nozzle exit orifice at a first selected convergence angle $\beta 1$ and said distal edge of the first converging wall segment defines a first orifice lip segment with a first selected lip width or transverse length $F_1W$; and wherein said second converging wall segment terminates in said shear nozzle exit orifice to define a second wall edge or lip segment and defines another interior fluid channel surface which intersects the shear nozzle exit orifice at a second selected convergence angle $\beta 2$ which is unequal to first selected convergence angle $\beta 1$, and wherein said distal edge of the second converging wall segment defines a second orifice lip segment with a second selected lip width or transverse length $F_2W$ which may be equal to or unequal to said first selected lip width $F_1W$.

* * * * *